US008834337B2

(12) United States Patent
Hannum et al.

(10) Patent No.: US 8,834,337 B2
(45) Date of Patent: Sep. 16, 2014

(54) METHOD OF FOLDING SHEET MATERIALS VIA ANGLED TORSIONAL STRIPS

(76) Inventors: Robert Joseph Hannum, Mountain View, CA (US); Andrew Scott Davies, San Francisco, CA (US); Mark Theodore Walsh, Brentwood, CA (US); Michael Shay Binion, Cary, NC (US); Mario Greco, Gibsonia, PA (US)

( * ) Notice: Subject to any disclaimer, the term of this patent is extended or adjusted under 35 U.S.C. 154(b) by 469 days.

(21) Appl. No.: 13/155,238

(22) Filed: Jun. 7, 2011

(65) Prior Publication Data

US 2012/0202669 A1 Aug. 9, 2012

Related U.S. Application Data

(60) Provisional application No. 61/397,074, filed on Jun. 7, 2010.

(51) Int. Cl.
*B31B 1/26* (2006.01)
*B31F 1/00* (2006.01)

(52) U.S. Cl.
CPC ..... *B31B 1/26* (2013.01); *B31B 2217/066* (2013.01); *B31F 1/0012* (2013.01); *B31B 2201/26* (2013.01)
USPC ..... 493/405; 72/324; 72/333

(58) Field of Classification Search
USPC ..... 493/162, 405, 407; 72/324, 325, 333, 72/339
See application file for complete search history.

(56) References Cited

U.S. PATENT DOCUMENTS

| | | | | |
|---|---|---|---|---|
| 975,121 | A | | 11/1910 | Carter |
| 1,698,891 | A | | 1/1929 | Overbury |
| 2,127,618 | A | | 8/1938 | Riemenschneider |
| 2,276,363 | A | | 5/1942 | Zalkind |
| 2,560,786 | A | | 7/1951 | Wright et al. |
| 2,634,467 | A | * | 4/1953 | Astrella ..... 52/717.03 |
| 2,890,825 | A | * | 6/1959 | Patrick ..... 229/68.1 |
| 3,258,380 | A | | 6/1966 | Fischer et al. |
| 3,341,395 | A | | 9/1967 | Weber |
| 3,756,449 | A | | 9/1973 | Dalli et al. |
| 3,756,499 | A | | 9/1973 | Giebel et al. |
| 3,788,934 | A | | 1/1974 | Coppa |
| 3,938,657 | A | | 2/1976 | David |
| 3,963,170 | A | | 6/1976 | Wood |
| 4,215,194 | A | | 7/1980 | Shepherd |
| 4,289,290 | A | | 9/1981 | Miller |

(Continued)

FOREIGN PATENT DOCUMENTS

| | | | |
|---|---|---|---|
| DE | 29818909 | U1 | 2/1999 |
| GB | 2129339 | A | 5/1984 |

(Continued)

*Primary Examiner* — Hemant M Desai

(57) ABSTRACT

One embodiment described herein is a sheet of material 200 formed into accurate and high value structures by implementing a plurality of elongated slots 202 that are obliquely placed along a fold line 204 which create one or more strips 206 consisting of a length w, a width s and an angle f to said fold line 204. The strips 206 are put into a state of plastic deformation through torsion which is controlled via the combination of said length w, width s, and angle f elements to create accurate, unique, complex and high value products or forms. The embodiments described allow for a greater degree of freedom of sheet material types, a greater degree of sheet material thicknesses, while simplifying implementation. This and other embodiments are also enclosed.

18 Claims, 15 Drawing Sheets

(56) References Cited

U.S. PATENT DOCUMENTS

| | | | | |
|---|---|---|---|---|
| 4,404,783 | A | 9/1983 | Freiborg | |
| 4,410,294 | A | 10/1983 | Gilb et al. | |
| 4,559,259 | A | 12/1985 | Cetrelli | |
| 4,628,661 | A | 12/1986 | St. Louis | |
| 4,792,085 | A | 12/1988 | Warring, III et al. | |
| 4,837,066 | A | 6/1989 | Quinn et al. | |
| 5,117,973 | A | 6/1992 | Lo Duca | |
| 5,225,799 | A | 7/1993 | West et al. | |
| 5,239,741 | A | 8/1993 | Shamos | |
| 5,568,680 | A | 10/1996 | Parker | |
| 5,692,672 | A | 12/1997 | Hunt | |
| 5,701,780 | A | 12/1997 | Ver Meer | |
| 5,789,050 | A | 8/1998 | Kang | |
| 6,132,349 | A | 10/2000 | Yokoyama | |
| 6,412,325 | B1 | 7/2002 | Croswell | |
| 6,481,259 | B1 | 11/2002 | Durney | |
| 6,640,605 | B2 * | 11/2003 | Gitlin et al. | 72/379.2 |
| 6,877,349 | B2 | 4/2005 | Durney et al. | |
| 7,152,449 | B2 | 12/2006 | Durney et al. | |
| 7,354,639 | B2 | 4/2008 | Durney et al. | |
| 7,374,810 | B2 * | 5/2008 | Durney et al. | 428/136 |
| 7,640,775 | B2 | 1/2010 | Durney et al. | |
| 8,377,566 | B2 * | 2/2013 | Durney et al. | 428/597 |
| 8,438,893 | B2 * | 5/2013 | Durney et al. | 72/324 |
| 2001/0010167 | A1 | 8/2001 | Leek | |
| 2002/0184936 | A1 * | 12/2002 | Gitlin et al. | 72/379.2 |
| 2003/0037586 | A1 | 2/2003 | Durney et al. | |
| 2004/0007040 | A1 | 1/2004 | Ibron et al. | |
| 2004/0134250 | A1 | 7/2004 | Durney et al. | |
| 2004/0206152 | A1 | 10/2004 | Durney et al. | |
| 2005/0005670 | A1 | 1/2005 | Durney et al. | |
| 2005/0061049 | A1 | 3/2005 | Durnet et al. | |
| 2005/0064138 | A1 | 3/2005 | Durney et al. | |
| 2005/0097937 | A1 | 5/2005 | Durney et al. | |
| 2005/0126110 | A1 | 6/2005 | Durney et al. | |
| 2006/0038978 | A1 * | 2/2006 | Zweig et al. | 356/56 |
| 2011/0008573 | A1 | 1/2011 | Durney | |

FOREIGN PATENT DOCUMENTS

| | | | |
|---|---|---|---|
| JP | 52-068848 | | 6/1977 |
| JP | 55-022468 | A | 2/1980 |
| JP | 55-055222 | U | 4/1980 |
| JP | 02-065416 | U | 5/1990 |
| JP | 02-192821 | A | 7/1990 |
| JP | 02-258116 | A | 10/1990 |
| JP | 04-033723 | A | 2/1992 |
| JP | 04-091822 | A | 3/1992 |
| JP | 05-261442 | A | 10/1993 |
| JP | 07-148528 | A | 6/1995 |
| JP | 08-224619 | A | 9/1996 |
| JP | 10-085837 | A | 4/1998 |
| JP | 11-123458 | A | 5/1999 |
| JP | 11-188426 | A | 7/1999 |
| WO | WO-97/24221 | A1 | 7/1997 |
| WO | WO-02/13991 | A1 | 2/2002 |

* cited by examiner

METHOD OF FOLDING SHEET MATERIALS VIA ANGLED TORSIONAL STRIPS

CROSS-REFERENCE TO RELATED APPLICATIONS

This application claims the benefit of provisional patent application Ser. No. 61/397,074 filed Jun. 7, 2010, filed by present inventor.

BACKGROUND

Prior Art

The following is a tabulation of some prior art that presently appears relevant:

U.S. PATENTS

| Pat. No. Number | Kind Code | Issue Date | Patentee |
|---|---|---|---|
| 975,121 | A | November 1910 | Carter |
| 1,698,891 | A | January 1929 | Overbury |
| 2,127,618 | A | August 1938 | Riemenschneider |
| 2,276,363 | A | March 1942 | Zalkind |
| 2,560,786 | A | July 1951 | Wright et al. |
| 3,258,380 | A | June 1966 | Fischer et al. |
| 3,341,395 | A | September 1967 | Weber |
| 3,756,449 | A | September 1973 | Dalli et al. |
| 3,756,499 | A | September 1973 | Giebel et al. |
| 3,788,934 | A | January 1974 | Coppa |
| 3,938,657 | A | February 1976 | David |
| 3,963,170 | A | June 1976 | Wood |
| 4,215,194 | A | July 1980 | Shepherd |
| 4,289,290 | A | September 1981 | Miller |
| 4,404,783 | A | September 1983 | Freiborg |
| 4,410,294 | A | October 1983 | Gilb et al. |
| 4,559,259 | A | December 1985 | Cetrelli |
| 4,628,661 | A | December 1986 | St. Louis |
| 4,792,085 | A | December 1988 | Waring, III et al |
| 4,837,066 | A | June 1989 | Quinn et al. |
| 5,117,973 | A | December 1988 | Lo Duca |
| 5,225,799 | A | July 1993 | West et al. |
| 5,239,741 | A | August 1993 | Shamos |
| 5,568,680 | A | October 1996 | Parker |
| 5,692,672 | A | December 1997 | Hunt |
| 5,701,780 | A | December 1997 | Ver Meer |
| 5,789,050 | A | August 1998 | Kang |
| 6,132,349 | A | October 2000 | Yokoyama |
| 6,412,325 | B1 | July 2002 | Croswell |
| 6,481,259 | B1 | November 2002 | Durney |
| 6,640,605 | B2 | November 2003 | Gitlin et al. |
| 6,877,349 | B2 | April 2005 | Durney et al. |
| 7,152,449 | B2 | December 2006 | Durney et al. |
| 7,354,639 | B2 | April 2008 | Durney et al. |
| 7,640,775 | B2 | January 2010 | Durney et al. |

U.S. PATENT APPLICATION PUBLICATIONS

| Publication Nr. | Kind Code | Publ. Date | Applicant |
|---|---|---|---|
| 2001/0010167 | A1 | August 2001 | Leck |
| 2002/0184936 | A1 | December 2002 | Gitlin et al. |
| 2003/0037586 | A1 | February 2003 | Durney et al. |
| 2004/0007040 | A1 | January 2004 | Ibron et al. |
| 2004/0134250 | A1 | July 2004 | Durney et al. |
| 2004/0206152 | A1 | October 2004 | Durney et al. |
| 2005/0005670 | A1 | January 2005 | Durney et al. |
| 2005/0061049 | A1 | March 2005 | Durney et al. |
| 2005/0064138 | A1 | March 2005 | Durney et al. |

-continued

| Publication Nr. | Kind Code | Publ. Date | Applicant |
|---|---|---|---|
| 2005/0097937 | A1 | May 2005 | Durney et al. |
| 2005/0126110 | A1 | June 2005 | Durney et al. |
| 2011/0008573 | A1 | January 2011 | Durney et al. |

FOREIGN PATENT DOCUMENTS

| Foreign Doc. Nr. | Cntry Code | Kind Code | Pub. Dt | App/Patentee |
|---|---|---|---|---|
| 29818909 | DE | U1 | February 1999 | Fortmeier |
| 2129339 | GB | A | May 1984 | Carter et al. |
| 52-068848 | JP | | June 1977 | |
| 55-022468 | JP | A | February 1980 | Yoshiichi |
| 55-055222 | JP | U | April 1980 | |
| 02-065416 | JP | U | May 1990 | |
| 02-192821 | JP | A | July 1990 | Yoshiichi |
| 02-258116 | JP | A | October 1990 | Naoki et al. |
| 04-033723 | JP | A | February 1992 | Hidetoshi |
| 04-091822 | JP | A | March 1992 | Naoki et al. |
| 05-261442 | JP | A | October 1993 | Naoki et al. |
| 07-148528 | JP | A | June 1995 | Tetsuya et al. |
| 08-224619 | JP | A | September 1996 | Tadashi |
| 10-085837 | JP | A | April 1998 | Takanori |
| 11-123458 | JP | A | May 1999 | Norio et al. |
| 11-188426 | JP | A | July 1999 | Kiyoji |
| 97/24221 | WO | A1 | July 1997 | Yokoyama |
| 02/13991 | WO | A1 | February 2002 | Durney |

NONPATENT LITERATURE DOCUMENTS

N/A

BACKGROUND

The present embodiment relates, in general, to the precision folding of sheet material and more particularly, relates to preparing and folding of sheet material capable of undergoing plastic deformation into three-dimensional structures.

BACKGROUND

Prior Art

Many aspects of modern living are touched upon by the methodologies of forming sheet materials into usable shapes. For instance, sheet materials are used extensively throughout transportation, structural members, packaging, machinery and artisan renderings. Among the many advantages of sheet material is that production can be automated, ran continuously and be optimized for maximum material usage.

Sheet materials tend to fit into a continuum between ductile and brittle. A brittle sheet material would be defined as one that is not capable of plastic deformation. Stated differently, brittle sheet materials are unable to absorb forming energy in order to permanently alter its original state. A ductile material is one able to be plastically deformed, which would permanently alter its original state. Thus, ductile types of sheet material have the ability to absorb forming energy. The forming of sheet materials has been limited by prior art to materials that are substantially on the ductile side of the spectrum. Many materials, such as but not limited to titanium, 6000 & 7000 series aluminum, magnesium and hardened steel, are not commonly used in complex parts made from sheet due to the difficulties in forming.

Complex sheet material forms typically require expensive tooling dies. These dies are complicated and expensive because of the high level of expertise required to avoid cracking and obtain proper shrinkage rates to avoid tearing. Also, the materials and the assembly of the dies are likewise cost prohibitive in low production runs. Similar complexity is also involved with forming sheet materials through rolling dies, which require a series of dies properly placed and manufactured to ensure proper part creation and eliminate distortion. Sheet materials must be suitably ductile to be drawn into the die cavities or rolled through the rolling dies. Such materials tend to be more expensive specialty alloys and can limit the strength of a part.

Bending via specialized machinery is another common method for forming sheet materials. Accuracy is a problem when bending a complex multifaceted component. Tolerance stack up errors from bend to bend can make parts with two or more folds unsuitable for high precision parts. The machine itself can get in the way and make certain geometries, like a deep four leaf box, considerably more difficult to fabricate. Curved bend lines also prove challenging due to the need for custom tooling based on the curve geometry. Another problem is that bending hardened high strength material including, but not limited to, titanium, 6000 & 7000 aluminum and hardened steel require a substantially large bend radius to avoid cracking and therefore, are unsuitable for many applications.

Other methods require the assembly of less complex parts that were formed with less accurate tooling. The assembly is combined using bending machines, fasteners or welding techniques that carry less tooling costs but decrease accuracy and stability, thus a loss of overall inherent value.

In addition to these stated fabrication issues, there are also additional problems created using three dimensional (3D) modeling tools in defining part construction. These problems arise when a designer creates a model of a part using a three dimensional program and sends the model to the fabrication floor or shop without knowing all of the practical fabrication steps in creating the physical product. This increases the possibility of creating incorrect parts or additional fabrication steps that add to product costs. Also, each fabricator takes the 3D model and applies their unique process to develop the flat of the part based on the dies and tools they have available. This process takes the fabricator time and skilled personnel and therefore, adds to the cost of a part and variations in quality from one fabricator to another.

To lower tooling costs, assembly steps and inaccuracy, most relevant work has been to create guiding slits or grooves parallel to the lines of forming or bending to facilitate accuracy and creation of more complex geometries. These methods suffer from the following disadvantages:

(a) Typical obround or rectangular openings create areas of stress concentration at their ends and can create crack propagation in less ductile materials.

(b) Bending a sheet material creates an area of concentrated compression on the inner surface and tension on the outer surface all within the bend region and when the bend region is smaller, the bend is more accurate but also more likely to crack materials that aren't substantially on the ductile side.

(c) Removing substantial material along a bend or forming line reduces the material integrity in the region and creates structural weakness.

(d) Accuracy is still an issue for complex parts with multiple related bends.

(e) Internal radii sizes are an issue when stacking several bent parts together or when wrapping bent materials over other sheet materials or structural members.

(f) Stresses are concentrated in areas that weaken final product strength in both static and cyclical loadings.

SUMMARY

In accordance with one embodiment, elongated slots are cut through a sheet material, so as to create a region of one or more substantially parallel elongated strips that are arranged oblique to and substantially centered on a predetermined fold line. The strips connect adjacent sections of sheet material and encourage the sheet material to fold at the fold line when said sheet is subjected to a moment force created by hand, fixture or simple machine. In this embodiment, the connecting strips undergo plastic deformation mainly via torsion rather than bending. For this reason, the term bending is not accurate and will be replaced with folding in regards to forming a sheet material with this embodiment. The method of forming sheet materials via angled torsional strips with the present embodiment has advantages which will be apparent from or are set forth in more detail in the accompanying drawings and the following detailed description, which together serve to explain the principles of the present embodiment.

Advantages

Accordingly, several advantages of one or more aspects are as follows: to create a sheet of material formed for folding that has highly accurate folds, that is easily implemented using conventional and inexpensive practices, that utilizes a minimum amount of tooling, that covers a wide range of sheet material thicknesses, that covers a wide range of sheet materials which include, but are not limited to, ductile and semi-ductile materials like titanium or 6061 T6 Aluminum, that allows for a very high level of complexity, that allows for folding in more than one direction, that allows for the ability to make more than one part out of one piece depending on which folds are formed and which ones are not, that removes inconsistencies between 3D modeling and final product, that can be used to vary the resulting fold radius that adds stability and value, that allows for the creation of structural members of immense length, that allows for a designer to use thinner material in applications of structure due to better use of material in structural members, that retains more base material strength than previous methods, that transfers loading from one plane to another in an efficient manner, and that reduces stress concentration. Other advantages of one or more aspects will be apparent from a consideration of the drawings and ensuing description.

DRAWINGS

Figures

In the drawings, closely related figures have the same number but different alphabetic suffixes.

DRAWINGS

Reference Numerals

Figure 1:
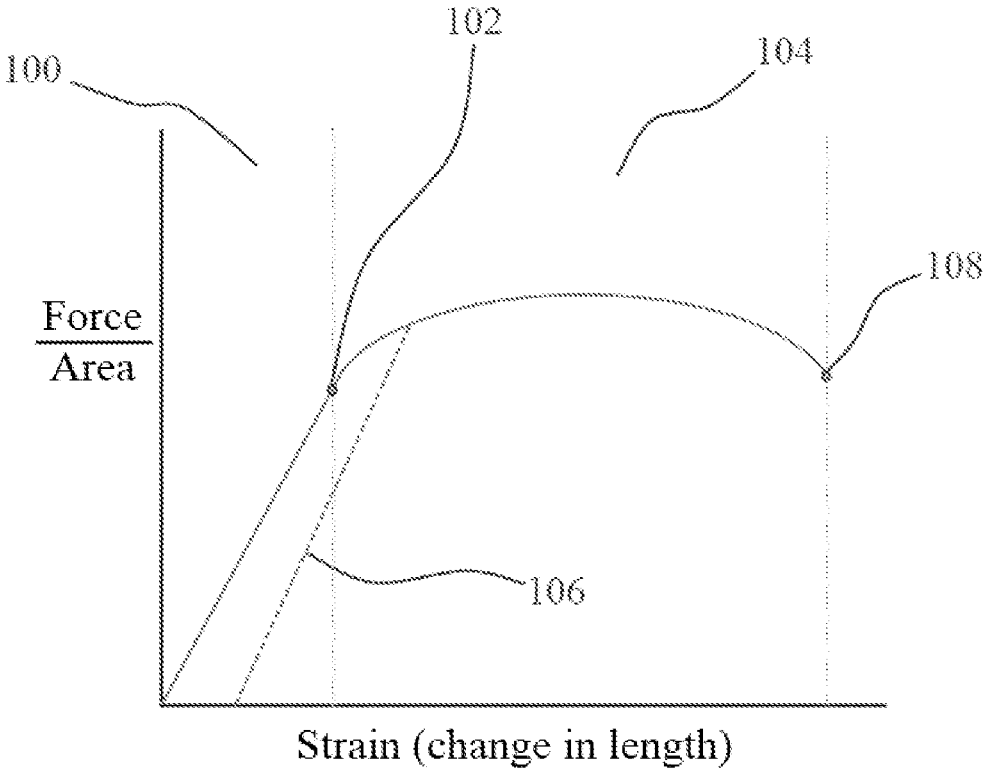
FIG. 1 shows the graph relating stress to strain and the plastic deformation region.

100 elastic region
102 yield strength
104 plastic region
106 spring back
108 ultimate strength
200 sheet of material
202 elongated slots
204 fold line
206 torsional strip
500 curved fold line
502 longitudinal axis
504 tangential axis
700 transverse axis of symmetry
800 bending strip
900 wide strip

DRAWINGS

Reference Variables

T=sheet thickness
w=slot length
c=slot width
s=distance between slots
f=angle between an elongated slot's longitudinal axis and a fold line
R,R',R"=internal radii where R<R' and R<R"

DETAILED DESCRIPTION

As stated above, the present embodiment relates to forming sheet material that can undergo plastic deformation. Such materials can be formed and retain the new shape. FIG. 1 shows a graph of stress, the amount of force acting on cross-sectional area of a material, and strain, the change in length of the material undergoing the stress. Materials that experience stresses within the elastic region 100 will return to their pre-stress length once the stress has been removed. Materials that are stressed beyond their yield strength 102 enter the plastic region 104 and permanent deformation occurs. Once the stress that is greater than the yield stress has been released, the material will experience spring back 106 and settle at a new deformed state. Materials stressed to their ultimate strength 108 will crack and break apart. In purely brittle materials the yield strength 102 and the ultimate strength 108 occupy the same point on the graph and therefore, have no plastic deformation region 104.

FIGS. 2 and 3A to 3H

First Embodiment

Figure 2:
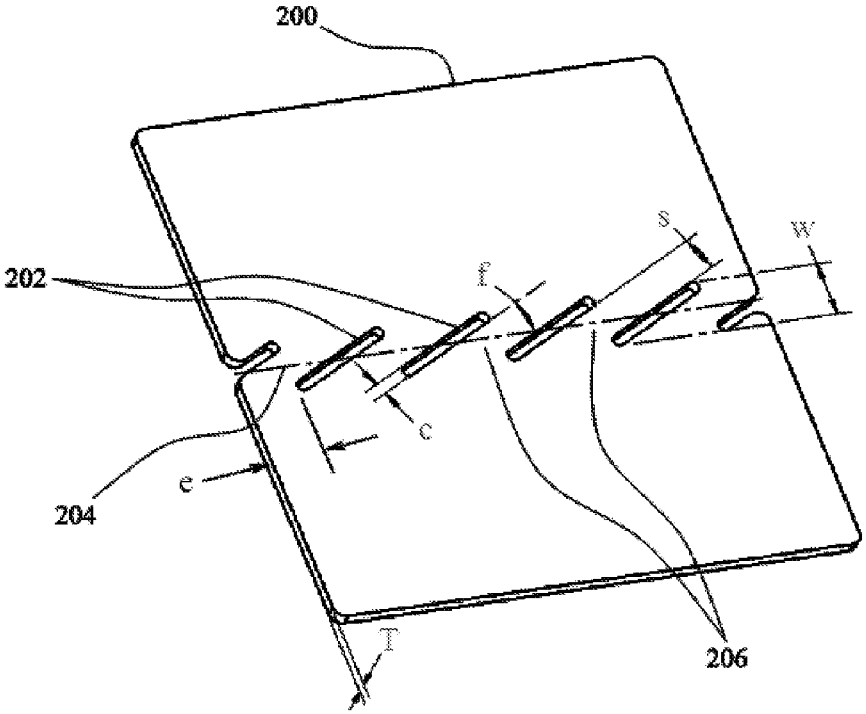
FIG. 2 shows the various aspects of a sheet of material formed for folding about a fold line, in which elongated slots are cut through the sheet material along the folding region to form a plurality of connective strip material in accordance with one embodiment.
Figure 3A:
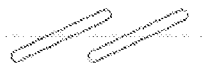
FIGS. 3A to 3H show various examples of slot geometries and the resulting strip of connective material.
Figure 3B:
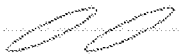
Figure 3C:
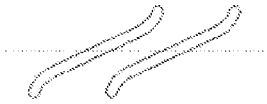
Figure 3D:
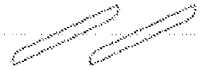
Figure 3E:
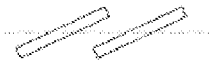
Figure 3F:
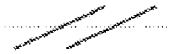
Figure 3G:
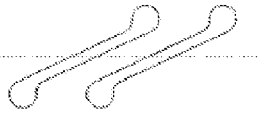
Figure 3H:
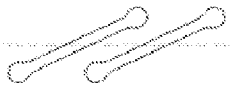

FIG. 2 shows the sheet of material formed for folding about a fold line. To prepare the sheet of material 200 with thickness T, a series of substantially parallel elongated slots 202 that are substantially centered on and oblique to the fold line 204 are cut through the material along the fold line. In accordance with one embodiment, the slots have predetermined measurements comprising elongated slots 202 of width c, a distance s apart, an angle f to the fold line, a length w and the last full slots 202 closest to the edges of the sheet material are a predetermined distance e from the edge. The slots create a web of strips 206 that connect two adjacent sections of sheet material. In one embodiment, the distance s can vary within the range of approximately T to eight times T, the angle f within the range of approximately 15° to 30°, the distance w within the range of approximately two times T to twelve times T and the length e is greater than three times T. Other embodiments are not limited to these ranges and can indeed extend outside the ranges, in order to create unique geometries or features.

The slots 202 may have many different geometries and stress relieving end shapes. FIGS. 3A through 3H show examples of different slot shapes and the strips created thereby, but the cut geometries should not be limited to this set of examples. The width of the slot c can be nearly zero if the slot is sheared or torn out with a shear punch tool or can be the width of a kerf from a laser cutter, water jet or plasma torch or can be a predetermined width from a punch tool or cutting path depending on the machine used to cut out the slot 202.

Operation

Figure 4A:
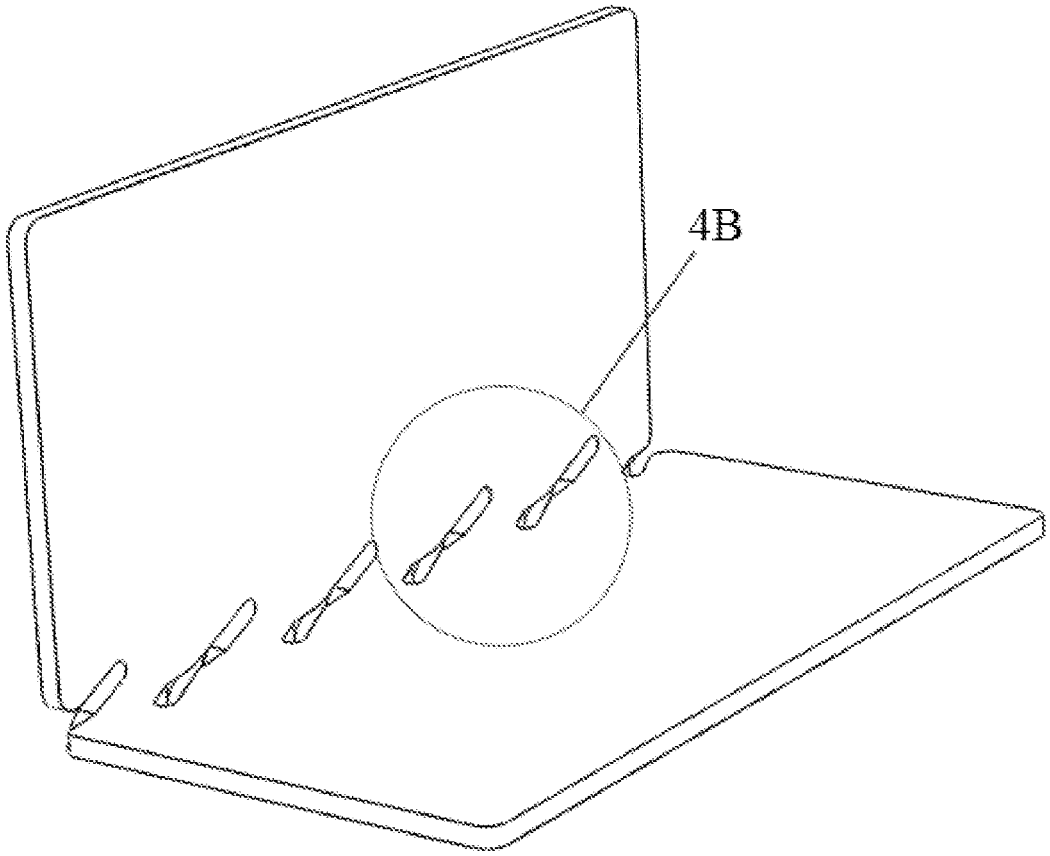
FIG. 4A shows the sheet material of FIG. 1 in the folded state at 90 degrees.
Figure 4B:
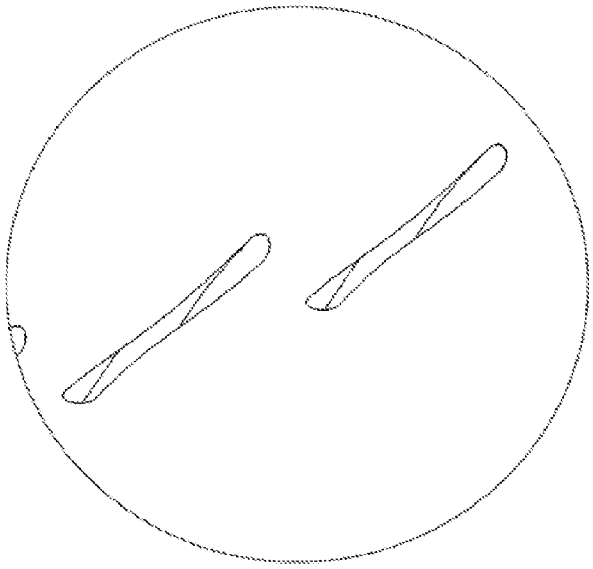
FIG. 4B shows a detailed view of the connective strip material twisted into its formed state.

FIGS. 4A and 4B

FIG. 4A shows the manner in which the current embodiment creates a folding region where the material goes through a plastic deformation due mainly to torsion rather than bending. FIG. 4B shows a close up of a strip of material 206 created from torsional forces where said strip 206 twists about its longitudinal axis as the sheet 200 is placed in a bending moment. This action puts the strip into a state of compression on all sides of the strip 206 when compared to typical bending methods, which create large disproportionate compression and tensile forces. In FIG. 4A, the sheet material 200 is shown folded to 90 degrees. This tight inner radius allows other folded sheets to be stacked tightly and creates accurate parts even with multiple related bends.

FIGS. 5-14

Additional Embodiments

Figure 5:
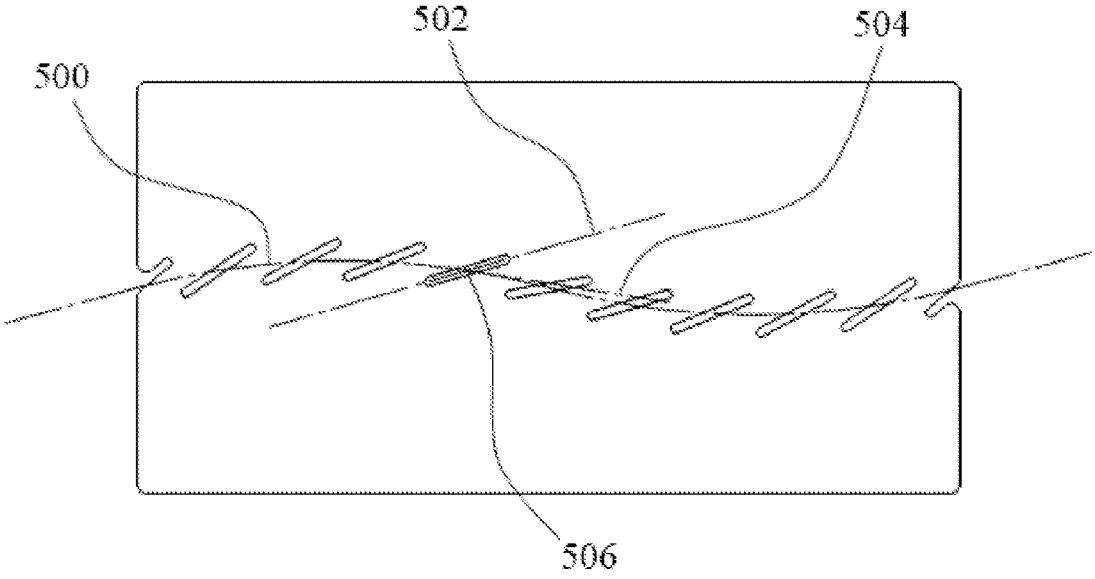
FIG. 5 shows another embodiment involving placing elongated slots along a compound curve fold line.
Figure 6:
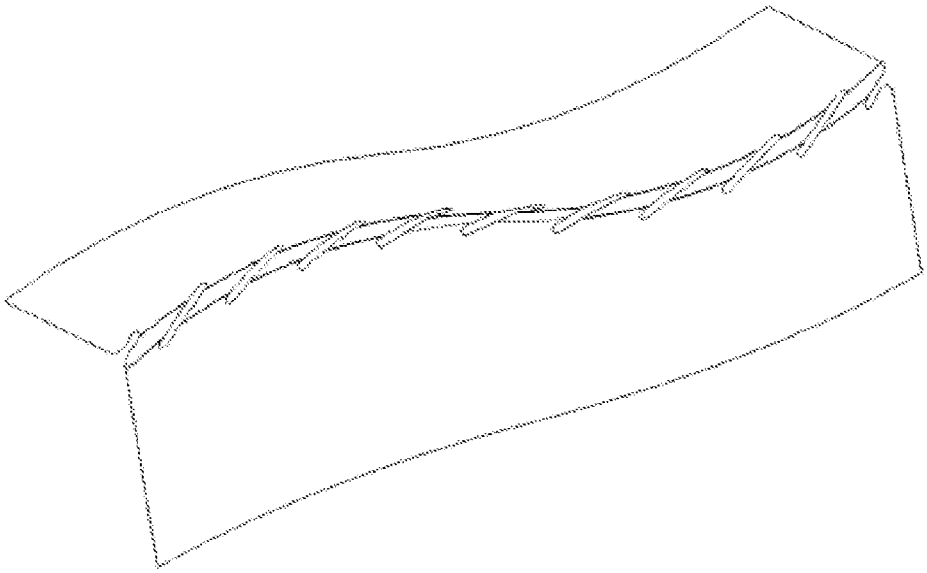
FIG. 6 shows the embodiment of FIG. 5 folded to 90 degrees.

In accordance with another embodiment, the fold line may be curved in one direction, any number of directions, irregularly, compound curved or the fold line may branch out into different fold lines. FIG. 5 shows a sheet of material formed in preparation for a curved fold in two directions or rather a spline with one node. The angle of the slot to the curved fold line 500 is measured from a longitudinal axis 502 in the center of slot's width and a tangential axis 504 originating at the intersection 506 of the curved fold line and slot's longitudinal axis 502. FIG. 6 shows a possible resultant shape from folding the sheet of material as shown in FIG. 5.

Figure 7A:
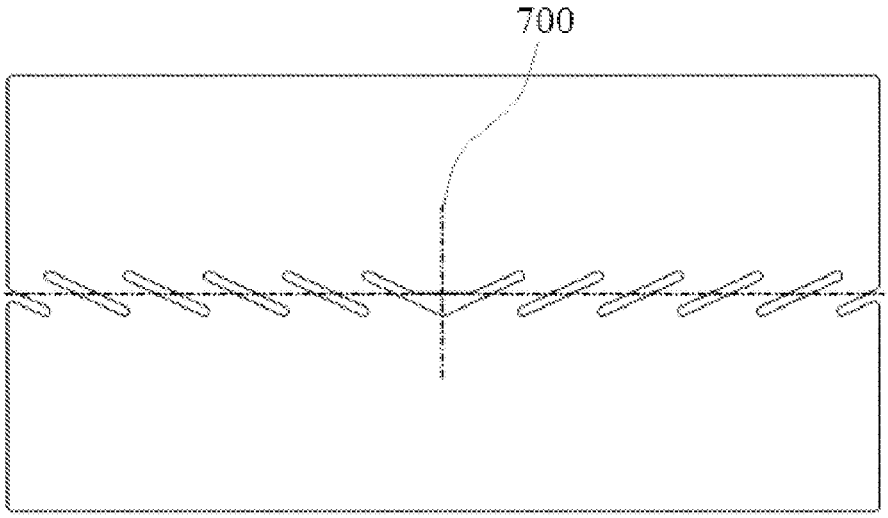
FIG. 7A shows the top view of another embodiment with an elongated slot pattern symmetric about an axis transverse to the fold line with the slots meeting at the transverse axis.
Figure 7B:
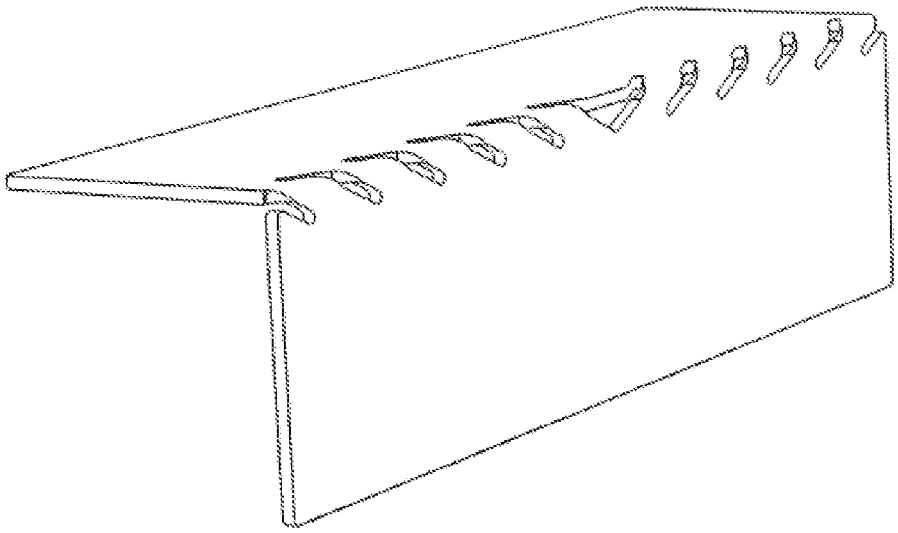
FIG. 7B shows the embodiment of FIG. 7A folded to 90 degrees.
Figure 8A:
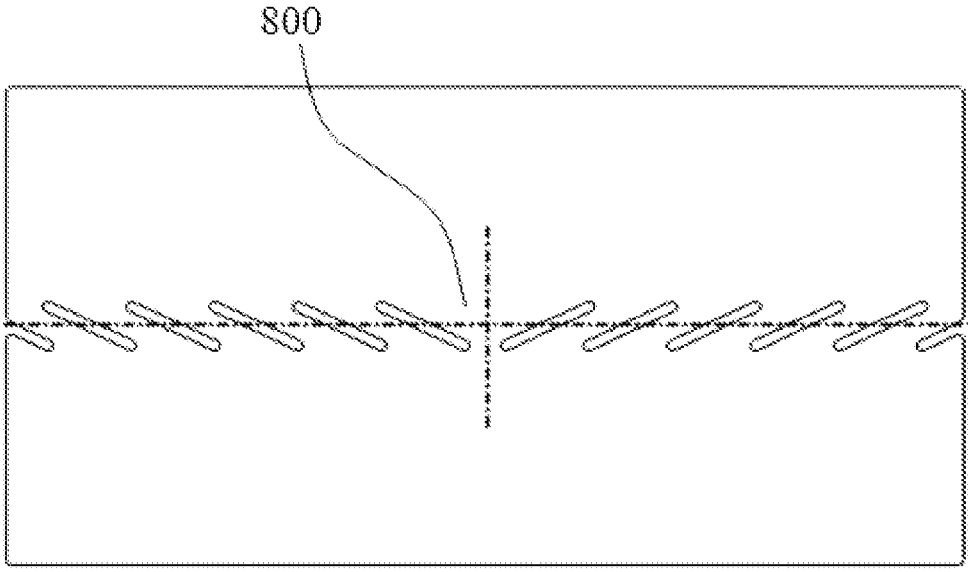
FIG. 8A shows the top view of another embodiment with a slot pattern symmetric about an axis transverse to the fold line with the slots separated at the transverse axis.
Figure 8B:
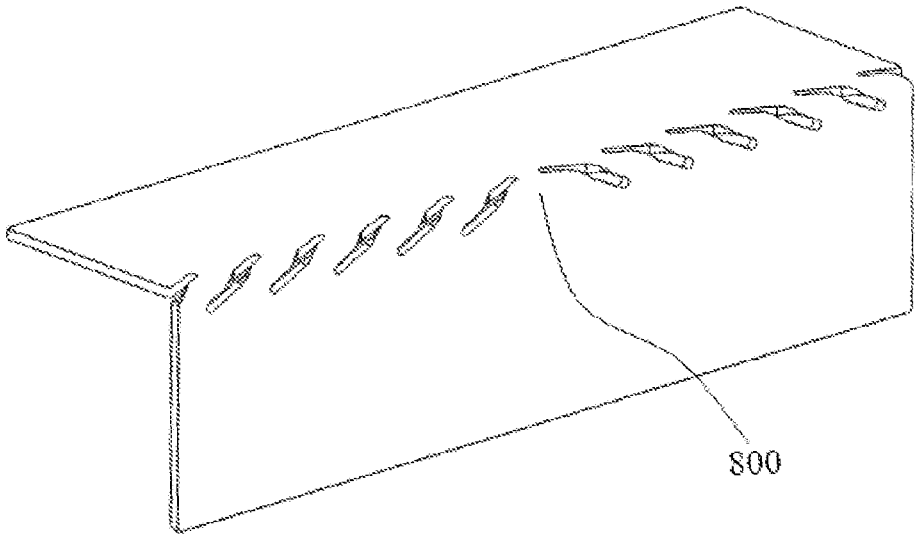
FIG. 8B shows the embodiment of FIG. 8A folded to 90 degrees.

In accordance with another embodiment, the slots can be approximately symmetric about an axis 700 transverse to the fold line at a predetermined distance along the fold line, as shown in FIGS. 7A and 8A. The ends of the slots can meet as shown in FIG. 7A or be separated by a predetermined distance as shown in FIG. 8A. The arrangement of slots in FIG. 8A creates a bending strip 800. FIGS. 7B and 8B shows the sheet of material from FIGS. 7A and 8A respectively, formed to a 90° angle.

Figure 9A:
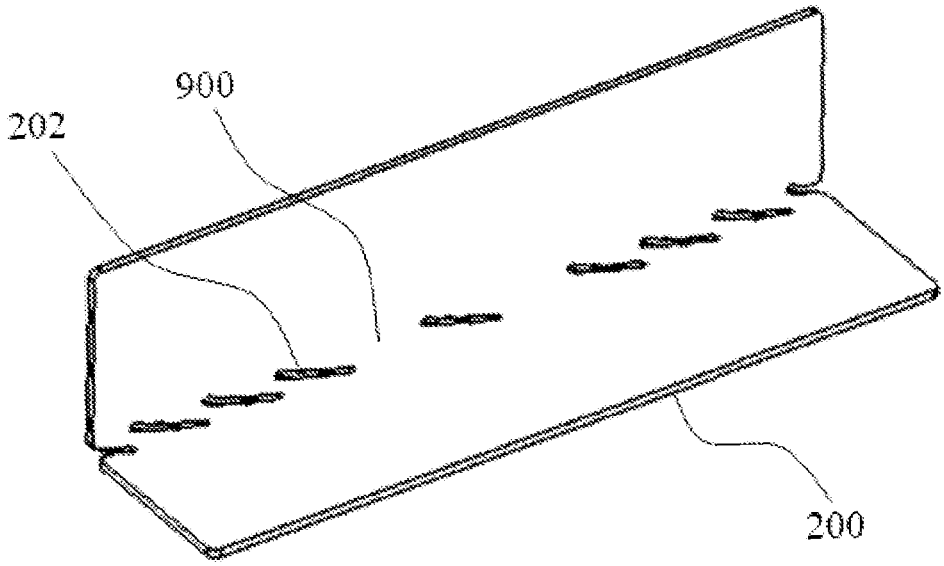
FIGS. 9A to 9D show the relation between the width of a strip and the inner radius of a fold.
Figure 9B:
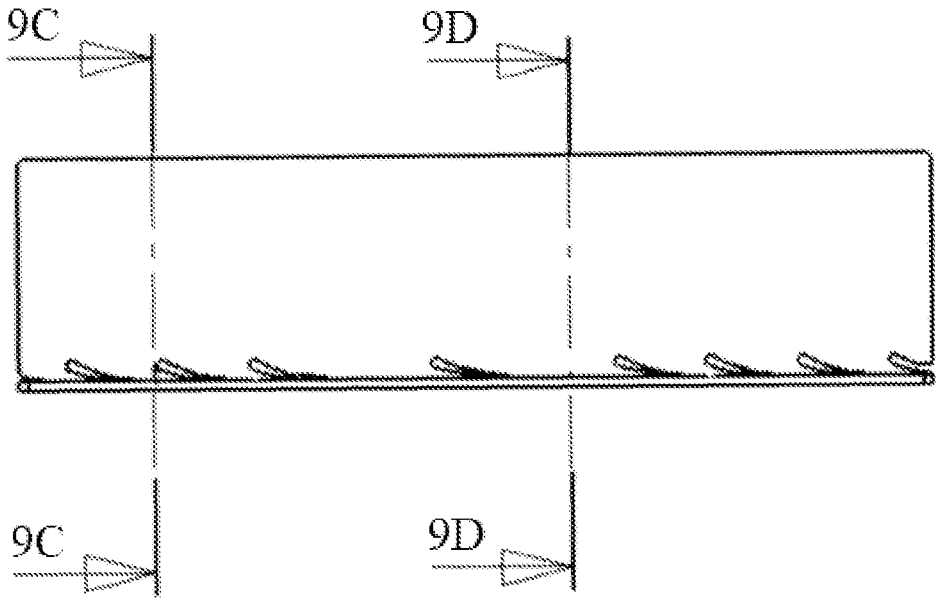
Figure 9C:
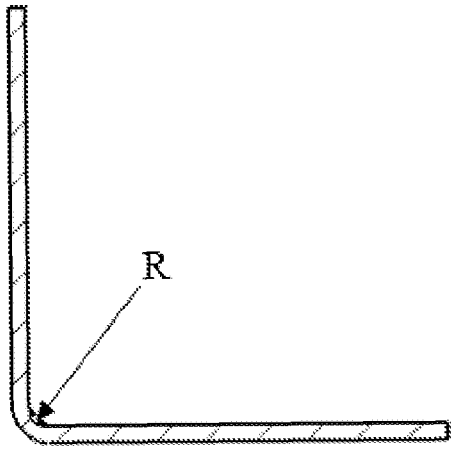
Figure 9D:
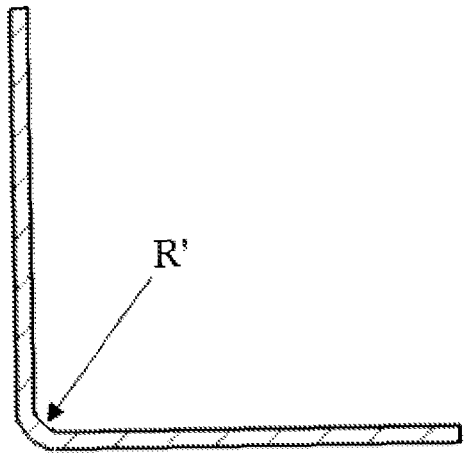

FIG. 9A shows a sheet of material 200 with a reduced number of elongated slots 202, which results in wider strips 900. FIG. 9B shows the location of the cross sectional views in FIGS. 9C and 9D. FIGS. 9C and 9D, show the resultant inner radii, R and R', respectively. R' is a larger inner radius than that of R. The wider strip increases the amount of sheet material 200 in the fold region and thus increases the local strength condition.

Figure 10A:
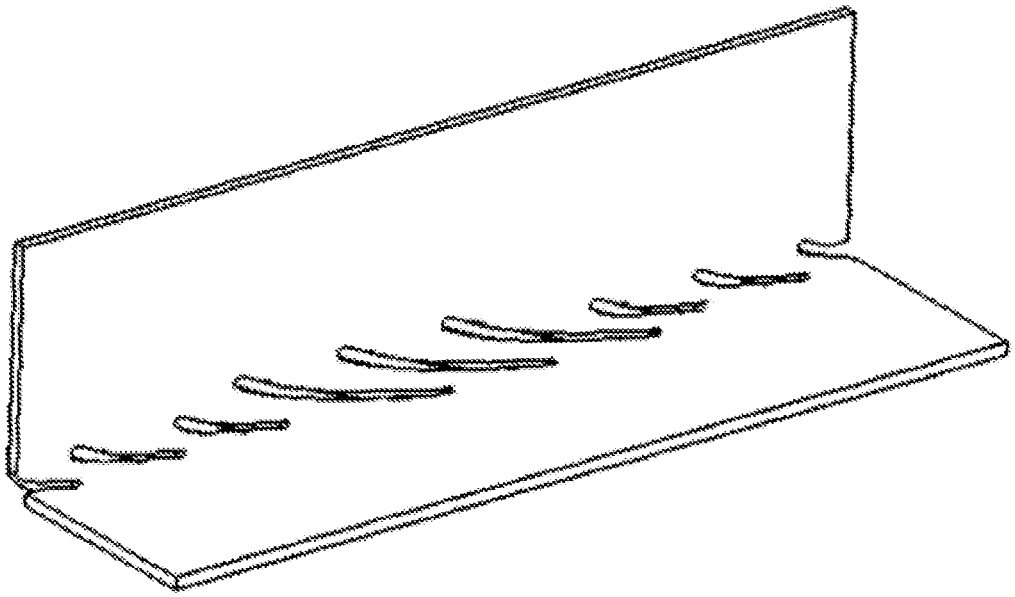
FIGS. 10A to 10D show the relation between the length of a strip and the inner radius of a fold.
Figure 10B:
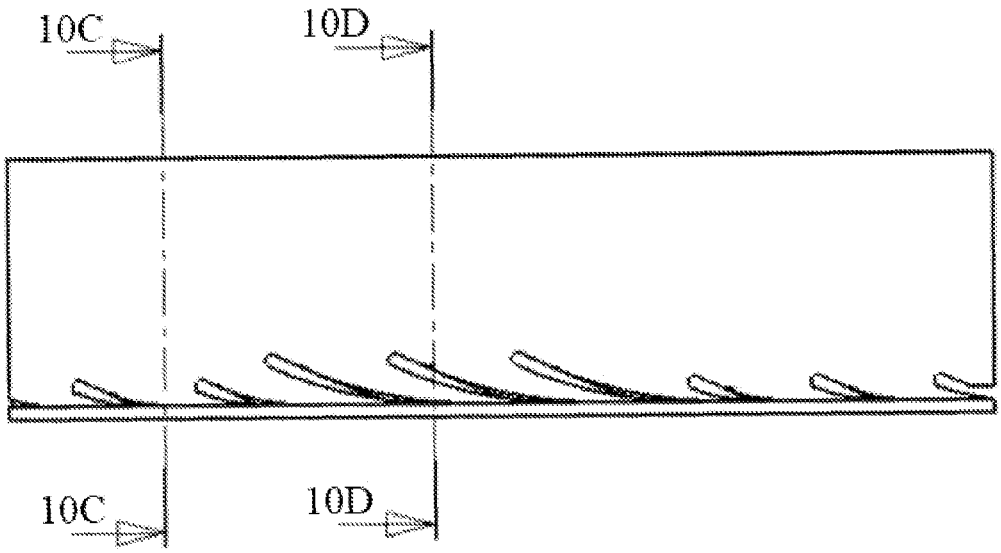
Figure 10C:
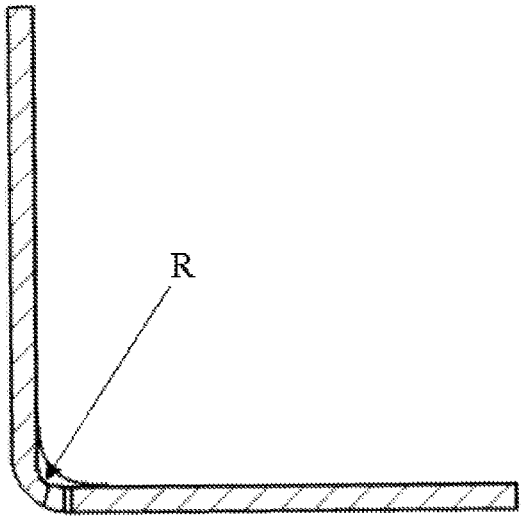
Figure 10D:
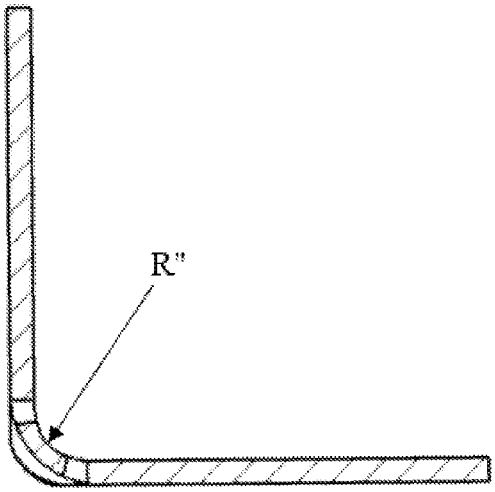

Another way to control the inner fold radius is shown in FIG. 10A, in accordance with another embodiment. As the slot length increases, so does the resulting inner fold radius. Decreasing the slot length increases accuracy. The slot length can be varied in order to vary the inner fold radius and maintain accuracy. FIG. 10B shows the location where the sectional views are located. FIG. 10C shows the inner radius R in the shorter slot region and FIG. 10D shows the larger inner fold radius R" in the longer slot region. The inner radius R is smaller than the inner radius R" created by the longer strips.

Figure 11A:
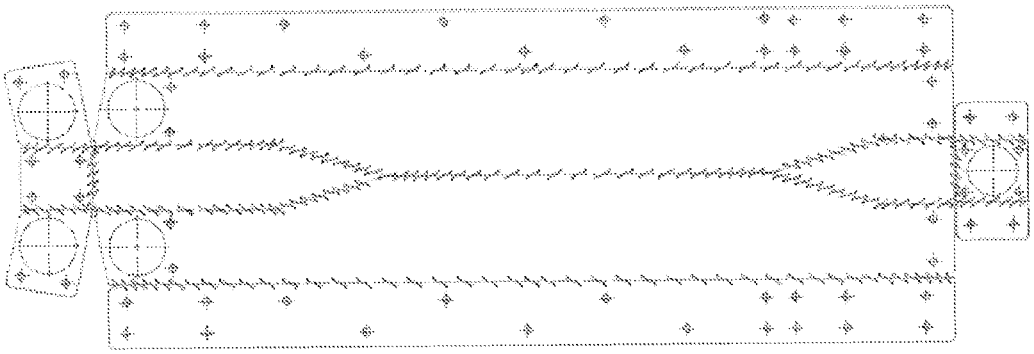
FIGS. 11A to 11E show various aspects of a sheet of material formed into a complex structure with varying cross sections in accordance with one or more embodiments.
Figure 11B:
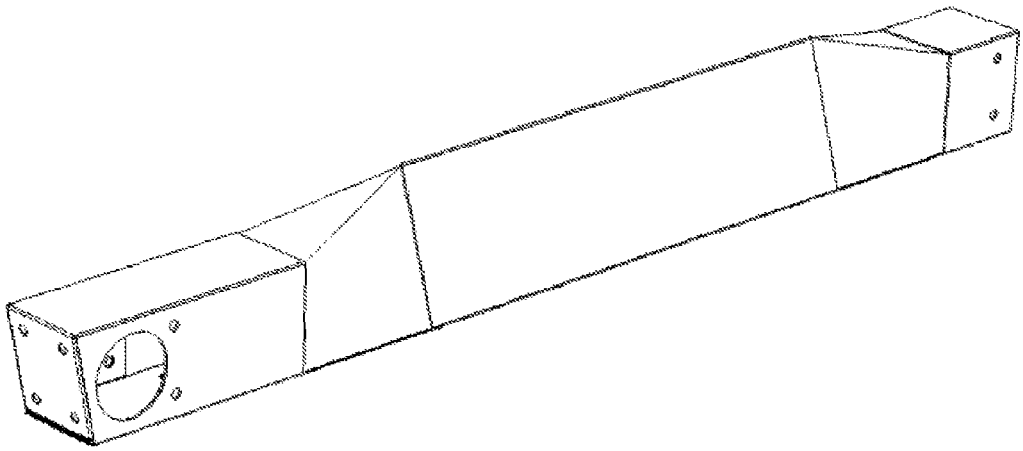
Figure 11C:
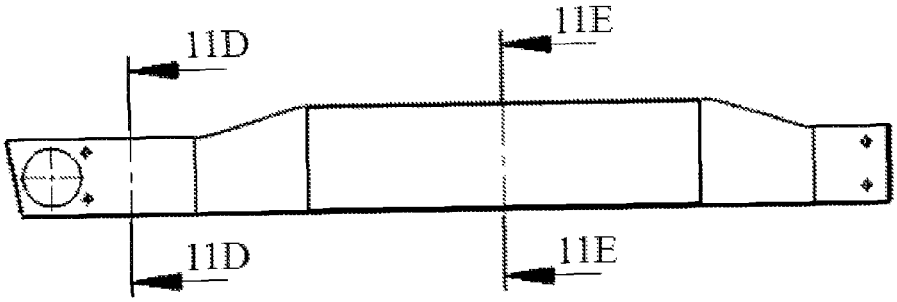
Figure 11D:
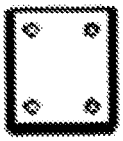
Figure 11E:
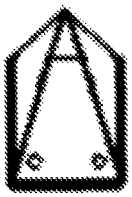

The embodiments described above can be combined in many different ways, in order to create complex shapes. FIG. 11A shows a sheet of material with strips of varying widths, fold lines that branch into different fold lines and recombine into another fold line. The resulting folded shape is shown in FIG. 11B. FIG. 11C shows the folded shape of FIG. 11A. FIGS. 11D and 11E show that the cross section along the beam varies from a square cross section to a triangular cross section and back to a square cross section. An assembler can easily mount components to a square section, while triangular sections resist bending and torsion better than the square sections. The strips are widest in the middle of the triangular section for increased beam strength.

Figure 12A:
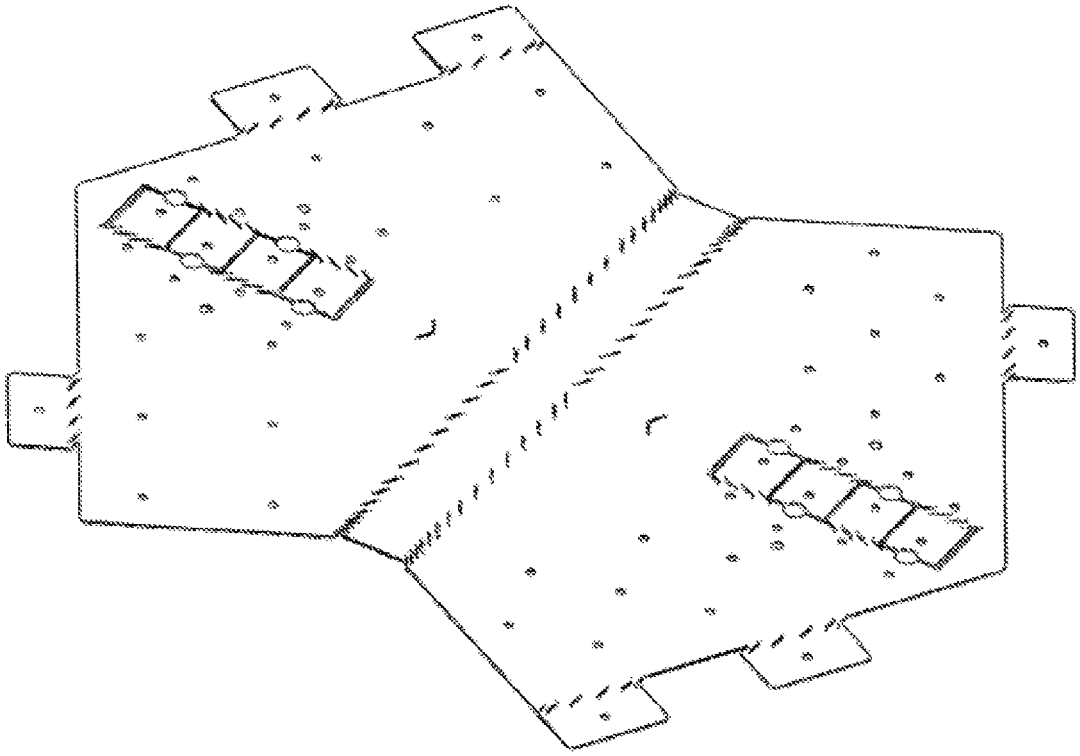
FIG. 12A shows a bracket in the flat state created out of a sheet of material in accordance one or more embodiments.
Figure 12B:
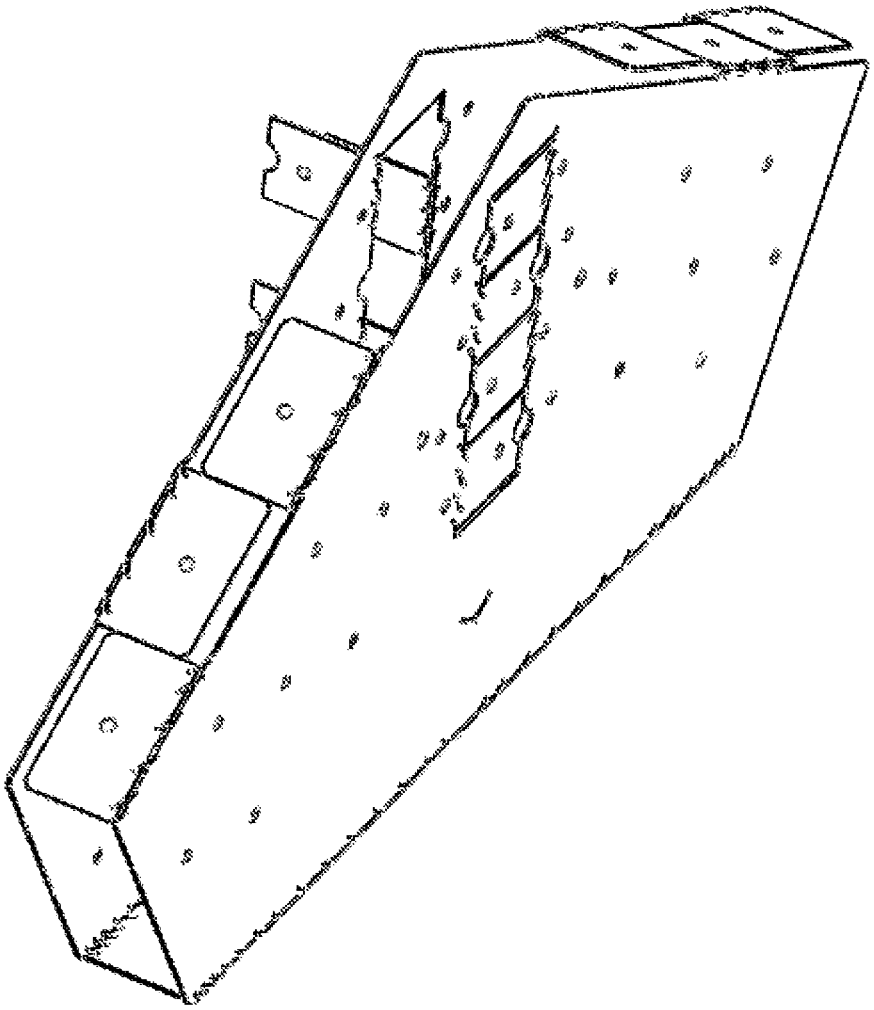
FIG. 12B shows the bracket of FIG. 12A in the folded state.

A sheet of material can be prepared for folding such that a product can be formed by the customer. FIGS. 12A and 12B show a peak truss bracket for building wood structures that can be shipped in the flat state and formed by the end user, in this case a carpenter or hobbyist, as needed. FIG. 12A shows the part in the flat state and 12B shows the folded state. The result is a strong clam shell design, that is difficult to implement without expensive tooling, which can be hand folded at the point of implementation.

Advantages

From the description above, a number of advantages of the embodiments become evident:

(a) The accuracy is equivalent or better than die tolerances, which reduces problems with tolerance build up of products having a plurality of bends.
(b) The implementation of the embodiments does not require extensive training in the fabrication of sheet material products and the many machines typically involved in forming sheet materials.
(c) Tooling or folding fixtures are not required but if used, such aids are inexpensive.
(d) A wide range of sheet material thicknesses can be utilized.
(e) The range of sheet material types within the ductile to brittle spectrum is expanded into an area not previously available by previous methods.
(f) The fold line is bidirectional, which means that the sheet material can be formed in either direction on the fold line.
(g) One sheet material formed for folding can be formed into many different parts depending on which fold lines are utilized or which way the sheet material is folded about a fold line.
(h) The transition from computer 3D model to the flat part is maintained by the designer, which saves time for the fabricator and gives more control to the designer.
(i) Value, stability, and style can be created by varying the distance between or length of the slots to change the inner radius of the fold.
(j) Rolling slots into a roll of sheet material allows for the creation of structural members, whose length is only limited by the length of the sheet material roll.
(k) Designers are able to make structures using thinner sheet materials thus saving material and money while maintaining value through the use of more complex and accurate geometries.
(l) The material removed to create the slots is less than the material removed in other indexing methods along the bend line thus maintaining a higher level stiffness and strength in the final sheet material product or structure.
(m) The transfer of loads through a fold is more efficient than through bends made by previous methods.
(n) Stress concentrations are reduced in the fold region.
(o) Tighter and straighter folds allow for a tighter fit in overlapping parts creating stronger connections.
(p) Sheet material products can be stacked and shipped flat after slots are introduced, which saves on storage space and shipping.

CONCLUSIONS, RAMIFICATIONS, AND SCOPE

Accordingly, the reader will be able to see that implementation of the above embodiments will enable the sheet material designer to create higher value products with less capital, to the benefit of the customer and fabricator, thus enlarging the potential of sheet materials in industry. Furthermore, the above embodiments have the additional advantages:

- it provides a method of creating a wider range of structures and parts made of sheet materials;
- it provides a method to utilize a wider range of sheet material types and thicknesses;
- it provides a method that can be implemented with little to no capital investment;
- it provides a method to obtain a higher level of sheet material fabrication value above and beyond traditional methods;
- it provides a method to lower processing and storage costs;

it allows the designer to create multiple parts from one piece depending on the fold lines that are utilized and the direction in which they are folded.

Although the description above contains many specifications, these should not be construed as limiting the scope of the embodiments but merely providing illustrations of several embodiments. For example, the slots can have a range of end conditions, such as square, triangular, rounded, curved, obround, etc.; the angle of such strips f can be a value larger than zero degrees to less than 90 degrees; the length w of the strips 204 can be of various lengths outside of the range described above in order to create unique geometries and can have a reasonably varied widths s outside the range specified above as allowed by the sheet material selected.

Thus the scope of the embodiments should be determined by the appended claims and their legal equivalents, rather than by the examples given.

What is claimed is:

1. A method for folding two adjacent sections of sheet material about an interposed fold line to form a three dimensional folded form, said method comprising:

(a) forming a plurality of elongated slots through said sheet material, wherein said slot is substantially centered on and oblique to said fold line, said slots form a plurality of substantially parallel elongated strips along the length of said fold line, said strips connect said adjacent sections of said sheet material (b) folding said adjacent sections of sheet material about said fold line, wherein said strips encourage said sheet of material to fold at said fold line by twisting along said strip's length w, whereby said sheet material can be folded into accurate, precise and complex structures.

2. The sheet material of claim 1, wherein said sheet material is composed of a material that is capable of undergoing plastic deformation.

3. The sheet material of claim 1, wherein said sheet material is selected from the group comprising of steel, aluminum, magnesium, titanium, brass, copper, nickel, and polycarbonate polymer.

4. The slot of claim 1, wherein the distance w from end to end of said slot as measured perpendicular to said fold line extends within the range of approximately two times to twelve times the thickness T of said sheet material.

5. The strip of claim 1, wherein said strip possessing a longitudinal axis extends at an angle f with respect to said fold line within the range of approximately 15° to 30° at point of intersection with said fold line and said longitudinal axis.

6. The strip of claim 1, wherein said strip of w extends in width s within the range of approximately equal to one thickness T to eight times the thickness T of said sheet material.

7. The fold line of claim 1, wherein said fold line is selected from the group comprising of a straight line, a line curved in one direction, an irregularly curved line, a spline with a plurality of nodes, a combination of straight and curved lines, a line which terminates within said sheet material and a line which furcates into a plurality of fold lines.

8. The method according to claim 1, wherein said forming device is selected from the group comprising of laser, punch, shear punch, laser/punch combination, water jet, plasma cutter, hard tool and rolling die.

9. The slot of claim 1, wherein said slots are substantially symmetric about an axis perpendicular to said fold line thereby creating a substantially symmetric pattern of strips about said axis.

10. A sheet material formed for folding along a fold line comprising:

(a) a sheet material having a plurality of elongated slots formed through the sheet material, wherein said slot is substantially centered on and oblique to a fold line, said slots form a plurality of substantially parallel elongated strips along the length of said fold line, whereby said strips twist when said sheet material is folded along said fold line creating accurate, precise and complex structures.

11. The sheet material of claim 10, wherein said sheet material is composed of a material that is capable of undergoing plastic deformation.

12. The sheet material of claim 10, wherein said sheet material is selected from the group comprising of steel, aluminum, magnesium, titanium, brass, copper, nickel, and polycarbonate polymer.

13. The slot of claim 10, wherein the distance w from end to end of said slot as measured perpendicular to said fold line extends within the range of approximately two times to twelve times the thickness T of said sheet material.

14. The strip of claim 10, wherein said strip possessing a longitudinal axis extends at an angle f with respect to said fold line within the range of approximately 15° to 30° at point of intersection with said fold line and said longitudinal axis.

15. The strip of claim 10, wherein said strip of length w extends in width s within the range of approximately equal to one thickness T to eight times the thickness T of said sheet material.

16. The fold line of claim 10, wherein said fold line is selected from the group comprising of a straight line, a line curved in one direction, an irregularly curved line, a spline with a plurality of nodes, a combination of straight and curved lines, a line which terminates within said sheet material and a line which furcates into a plurality of fold lines.

17. The method according to claim 10, wherein said forming device is selected from the group comprising of laser, punch, shear punch, laser/punch combination, water jet, plasma cutter, hard tool and rolling die.

18. The slot of claim 10, wherein said slots are substantially symmetric about an axis perpendicular to said fold line thereby creating a substantially symmetric pattern of strips about said axis.

* * * * *